United States Patent [19]

Buquet et al.

[11] 4,023,700

[45] May 17, 1977

[54] CONTAINER FOR PRESSURIZED LIQUID HAVING A NON-RIGID WALL

[75] Inventors: Alain Buquet, Gif-sur-Yvette; Louis Doyen, Lyon, both of France

[73] Assignees: SCAL - Societe de Conditionnements en Aluminum, Paris; Thimonnier S.A., Lyon, both of France

[22] Filed: May 4, 1976

[21] Appl. No.: 682,907

[30] Foreign Application Priority Data

May 23, 1975 France ..... 75.16737
Feb. 13, 1976 France ..... 76.04522

[52] U.S. Cl. ..... 220/63 R; 220/67; 220/69; 220/71

[51] Int. Cl.[2] ..... B65D 7/12; B65D 7/44; B65D 25/14

[58] Field of Search ..... 220/66, 67, 68, 69, 220/71, 73, 85 K, 1 BC, 63 R; 215/1 C; 229/3.5 MF, 4.5, 5.5

[56] References Cited

UNITED STATES PATENTS

| | | | |
|---|---|---|---|
| 2,819,007 | 1/1958 | Bergstrom | 229/5.5 |
| 3,143,243 | 8/1964 | Mackusick | 220/69 |
| 3,259,296 | 7/1966 | Beranger | 229/5.5 |
| 3,406,891 | 10/1968 | Buchner et al. | 220/67 X |
| 3,416,703 | 12/1968 | Chmielowiec | 220/73 |
| 3,542,229 | 11/1970 | Beyerlein et al. | 215/1 C |
| 3,687,351 | 8/1972 | Kaercher et al. | 229/3.5 MF X |
| 3,712,497 | 1/1973 | Jones | 220/66 X |

*Primary Examiner*—Stephen Marcus
*Attorney, Agent, or Firm*—Dennison, Dennison, Meserole & Pollack

[57] ABSTRACT

A flexible-walled cylindrical container for pressurized liquid having an improved end construction of generally conical configuration recessed within the end edge of the cylinder, the conical end member having its edge turned toward the outside to form an annular wall which is fixed to the container wall. A rigid foam reinforcing annulus may be placed in the peripheral channel between the conical part of the base and the turned edge.

5 Claims, 3 Drawing Figures

CONTAINER FOR PRESSURIZED LIQUID HAVING A NON-RIGID WALL

The present invention concerns a new and improved container or packaging for pressurized liquids, more especially for beer, in small unit portions.

For a very long time, the conventional glass bottle was the only type of container used for "flat" or carbonated liquids. However, for small amounts such as a quarter or third of a liter, its weight was not reduced proportionally to the contents. Moreover, its fragile nature posed problems in distribution.

New forms of packaging have thus appeared on the market. For "flat" beverages, that is to say those not having any internal pressure, and especially for small quantities, laminated flexible containers or packs occupy a large part of the market; for pressurized or carbonated beverages, metal cans have in particular captured a sizable part of the market. However, these cans are costly since normally the cover is provided with an easy opening device. The metal which is involved poses environmental problems which sometimes provokes public reaction which may even go as far as demanding banning such cans.

Other tests have been carried out on packaging beer and similar carbonated beverages in plastic containers, but the high pressure which is characteristic of these liquids poses problems of impermeability. Even with thick walls, and consequently relatively rigid walls, the porosity of plastic materials cannot be completely avoided, and this has a deleterious effect on the preservation of the products.

The invention forming the object of the present application concerns a flexible wall receptacle for pressurized liquids which is light and is inexpensive, whose rigid base gives it a shape when empty which facilitates filling, and whose welding of the base to the body is particularly strong. Furthermore, once the contents of this flexible wall receptacle have been removed the said receptacle may easily be reduced to a minimal volume.

In order to obtain this result, the receptacle for packaging liquids under pressure in units for individual consumption in accordance with the invention is formed by a cylindrical body whose two ends are closed by bases in the form of conical or frustoconical elements wherein the edge of the base is turned towards the exterior of the receptacle and is secured to the internal wall of the cylindrical body at a certain distance from the free edge of the opening it is intended to seal, the smallest diameter of these elements being almost in the planes of the ends of the cylindrical body.

In a particular embodiment, the turned edge of the base is reinforced by a rigid annular element arranged in the peripheral groove or channel formed between the edge turned towards the exterior, and the conical or frustoconical part of the base. This annular reinforcement element may consist of a plastic material cast while or after the turned edge is secured to the internal wall of the cylindrical body.

Thus, in a recommended embodiment the space between the conical wall of the base element and the vertical wall of the cylindrical body is filled with a rigid thermplastic foam material.

In a preferred embodiment, at least the internal wall of the cylindrical tube and the internal wall of the sealing element are made of a heat-weldable material.

In order to further improve the behavior of the receptacle under pressure, a ribbon-like band is wound round the two ends of the cylindrical wall which assists in clamping the two bases. This formation of a ribbon-like band consists of winding an adhesive and preferably thermoretractable strip or band around each of the ends of the receptacle at the welding seams of each base.

In order to reinforce the body of the receptacle and reduce the thickness of the sheet material forming the body of the receptacle, it is also possible to make one or more intermediate bands transversely on the body of the receptacle, in other words, forming one or more rings around the body of the receptacle using an adhesive strip similar to that used to reinforce the ends.

The invention will be better understood by referring to the examples described hereinafter and in the accompanying drawings.

Figure 1:
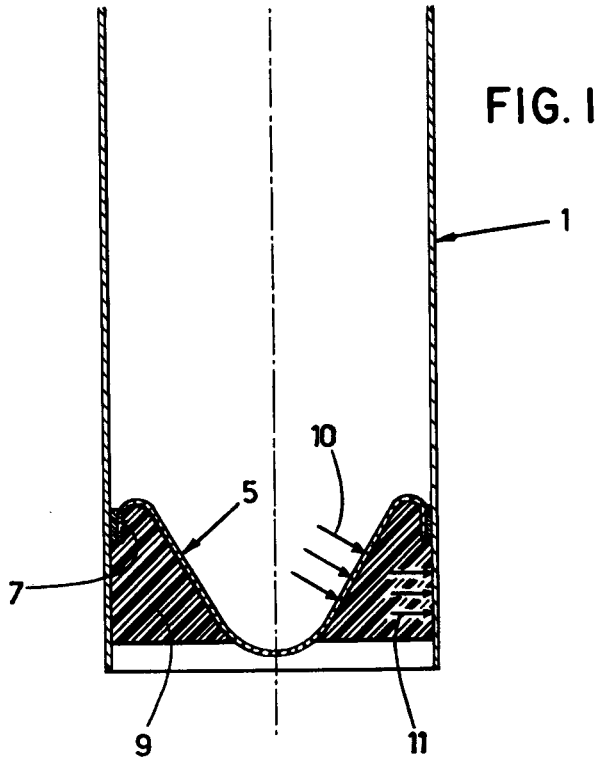
FIG. 1 shows the receptacle in vertical section closed at the bottom and ready to receive a carbonated beverage before being closed by the upper base part.

The cylindrical body 1 is in the present case formed by three layers which, going from the exterior to the interior, consist of a sheet 2 of high density polyethylene having a thickness of 30 to 40 $\mu$, a sheet 3 of aluminum having a thickness of 15 to 20 $\mu$, and a sheet 4 of high density polyethylene having a thickness of 60 to 80 $\mu$. This body may be obtained for example by "winding" "rolling" this composite laminated product and then welding it along a generatrix.

The base element 5 consists of a material similar to that of the cylindrical body 1, including layers 2', 3'and 4', and is formed by a stamping or hot formation operation in such a way that the edge 6 of its base is turned and forms a cylindrical part 7 having an external diameter approximately equal to the internal diameter of the cylindrical body 1.

Figure 2:
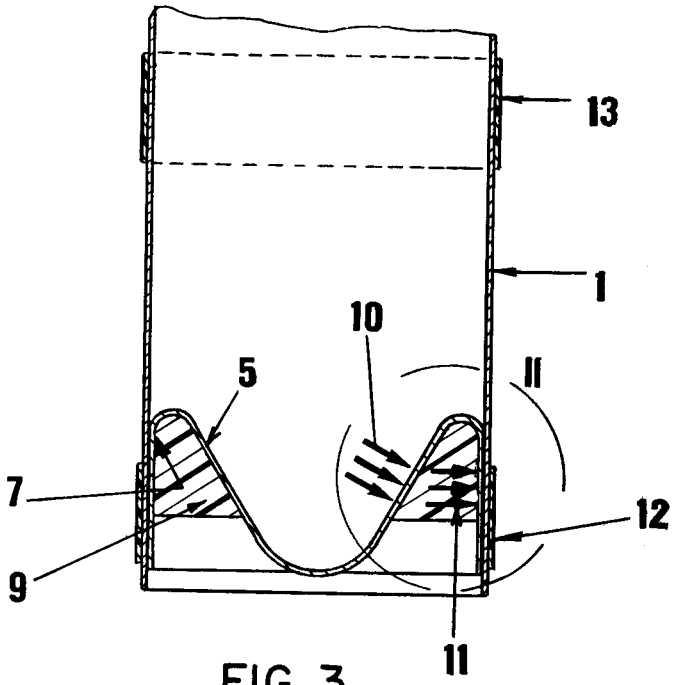
FIG. 2 shows a variant of the same receptacle.
Figure 3:
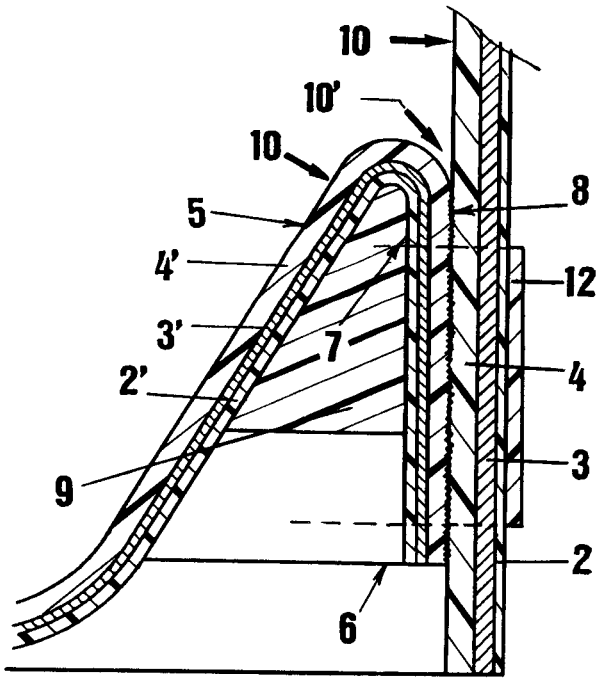
FIG. 3 shows on an enlarged scale the detail designated as II in FIG. 2.

Because of the small scale of FIGS. 1 and 2, the multiple layers of body 1 and base element 5 have only been shown in the enlarged scale detail of FIG. 3.

As a result of this turning effect, the internal sheet 4' of the base comes into contact with the sheet 4 which forms the internal wall of the body 1, and it is possible to combine these two materials by a welding operation. The welded seam 8 thus formed intimately unites the bases 5 to the body 1, and the receptacle obtained has perfect impermeability.

As regards resistance to pressure, the cylindrical wall 1 poses few problems. On the other hand, the forces exerted on the truncated part of the bases may well deform the latter which will sooner or later lead to a rupture in the welded seam 8. In order to remedy this danger, the channel of triangular cross-section between the truncated wall of the bases 5 and the cylindrical wall of the body 1 is filled with a rigid foam of thermoplastic material 9. This rigid foam transmits the internal pressures 10 which have components parallel to the welded seam zone 8 onto the cylindrical wall 1, thereby preventing the edge of the turned part 7 coming away from the base 5. The rigid foam is formed from a plastic material which, as soon as it is injected, forms an intimate bond with the external layer 2' of the base element 5, and possibly with the interior layer 4 of the cylindrical body 1. In the example shown in FIG. 1, the rigid foam 9 extends beyond the cylindrical part 7 of the base and comes into contact with the end of the interior layer 4 of the cylindrical body 1 to which it will adhere.

The receptacle shown in FIGS. 2 and 3 was produced with a smaller amount of foam 9. The foam fills only the base of the channel between the truncated wall of the base 5 and its cylindrical part 7 without extending beyond the edge 6, and thus does not come into contact with the internal layer 4 of the cylindrical body. One the other type of embodiment is possible, depending on the characteristics of the materials employed.

Despite the reinforcement produced by the annular foam element 9, the greatest difficulty to resolve in this type of receptacle is the behavior of the welded seam 8, which tends to open under the effect of the pressure forces 10 and 10′ (FIG. 3). It comes apart, starting from the interior, under the effect of the force 10′. During this progressive opening of the welded seam 8, the end of the cylindrical body 1 is strongly influenced and tends to splay out towards the exterior.

It was found that by clamping each end of the body 1 by an encircling or winding procedure involving an adhesive strip 12 it was possible to reinforce the receptacle to a great extent at little cost, or, inversely, for the same resistance to pressure to reduce the thickness of the wall of the cylindrical body 1, as well as the size of the annular element of rigid foam 9. This reinforcement is shown in FIGS. 2 and 3. The adhesive strip used in the example had a width of 15 mm.

The adhesive strip 12 will preferably be made of a thermoretractable material in order to seal better the two ends of the body at each of the welded seams 8.

During pressure tests on bases which were reinforced with rolls or strips, the base element 5 no longer came away in one piece as was previously the case, and the receptacle withstood the forces until the wall itself split.

One or more windings 13 of adhesive strip will also enable the body of the receptacle to be reinforced at least to some extent, or conversely enable the wall thickness of the cylindrical body 1 to be reduced for the same pressure resistance.

Receptacles have also been produced using a composite unit consisting of several layers, such as the four-layer unit made up in the following manner: an internal layer of polyethylene ensuring the functions of chemical protection and welding of the sheet; an aluminum layer providing impermeability and opacity; a paper layer providing improved rigidity; and an external polyethylene layer which renders the paper impermeable and enables the body to be welded longitudinally.

To obtain a thermohardening foam, one of the products used was a mixture comprising 50% of Desmophen 800 and 50% of Desmodur VL, and 1% of Desmorapid PP. This foam may be mixed with an inert product such as talcum, kaolin or titanium dioxide.

We claim:

1. A flexible wall container for packaging pressurized liquids comprising, a cylindrical body of flexible material, a base member closing each end of said container, at least one of said base members of generally conical configuration with the apex thereof facing axially outwardly of the container end, the edge of said one base member being turned outwardly to define an annular wall, said wall being secured to the inside of said cylindrical body, and a rigid pressure transmitting annular reinforcing element received within the peripheral channel formed between the turned edge and the generally conical part of the base member, said reinforcing element filling at least a portion of said channel and adhering to both the turned edge and the generally conical part of the base for transmitting internal container pressure to the outwardly turned edge and surrounding cylindrical body.

2. A container as defined in claim 1 wherein said wall is secured to the inside of said cylindrical body with its free edge spaced substantially inwardly of the container end and said apex being spaced only slightly inwardly from said container end.

3. A container as defined in claim 1 wherein the interior surface of the cylindrical body and the interior surface of said base member are formed of a thermoweldable material.

4. A flexible wall container for packaging pressurized liquids comprising, a cylindrical body of flexible material, a base member closing each end of said container, at least one of said base members being of generally conical configuration with the apex thereof facing axially outwardly of the container end, the edge of said one base member being turned outwardly to define an annular wall, said wall being secured to the inside of said cylindrical body and a rigid annular reinforcing element received within the peripheral channel formed between the turned edge and the generally conical part of the base member, said rigid reinforcing element being formed of a foamed thermoplastic material.

5. A flexible wall container for packaging pressurized liquids comprising, a cylindrical body of flexible material, a base member closing each end of said container, at least one of said base members being of generally conical configuration with the apex thereof facing axially outwardly of the container end, the edge of said one base member being turned outwardly to define an annular wall, said wall being secured to the inside of said cylindrical body, said wall being secured to the inside of said cylindrical body with its free edge spaced substantially inwardly of the container end and said apex being spaced only slightly inwardly from said container end, and a rigid foamed thermoplastic annular reinforcing element received within the peripheral channel between the generally conical part of the base member and the wall of the cylindrical body.

* * * * *